US007093644B2

(12) United States Patent
Strand

(10) Patent No.: US 7,093,644 B2
(45) Date of Patent: Aug. 22, 2006

(54) WINDOW COVERING WITH LIFTING MECHANISM

(75) Inventor: Toralf H. Strand, Madison, WI (US)

(73) Assignee: Springs Window Fashions LP, Fort Mill, SC (US)

( * ) Notice: Subject to any disclaimer, the term of this patent is extended or adjusted under 35 U.S.C. 154(b) by 79 days.

(21) Appl. No.: 10/452,170

(22) Filed: Jun. 2, 2003

(65) Prior Publication Data

US 2004/0250965 A1 Dec. 16, 2004

(51) Int. Cl.
*E06B 9/30* (2006.01)

(52) U.S. Cl. ..... 160/170

(58) Field of Classification Search ..... 160/170 R, 160/171 R, 168.1 R, 168.1 P, 173 R, 191, 160/192, 193, 84.06, 170, 171, 84.04, 84.05; 185/39, 45, 37; 267/155, 156
See application file for complete search history.

(56) References Cited

U.S. PATENT DOCUMENTS 4,621,673 A * 11/1986 Georgopoulos et al. . 160/168.1 R
4,719,992 A 1/1988 Elward et al.
5,482,100 A 1/1996 Kuhar
5,531,257 A 7/1996 Kuhar
5,706,876 A 1/1998 Lysyj
5,749,405 A 5/1998 Huang
5,813,447 A 9/1998 Lysyj
5,819,832 A 10/1998 Huang
5,850,863 A 12/1998 Huang
5,904,198 A 5/1999 Huang
5,960,846 A 10/1999 Lysyj
6,012,506 A 1/2000 Wang et al.
6,024,154 A 2/2000 Wang et al.
6,029,734 A 2/2000 Wang et al.
6,047,759 A 4/2000 Lysyj
6,056,036 A 5/2000 Todd et al.
6,079,471 A 6/2000 Kuhar
6,095,222 A 8/2000 Voss
6,129,131 A 10/2000 Colson
6,129,181 A 10/2000 Weems
6,149,094 A 11/2000 Martin et al.
6,223,802 B1 5/2001 Colson
6,234,236 B1 5/2001 Kuhar
6,283,192 B1 9/2001 Toti
6,289,965 B1 9/2001 Ruggles
6,293,329 B1 9/2001 Toti
6,325,131 B1 12/2001 Dekker et al.
6,330,899 B1 12/2001 Ciuca et al.
6,412,537 B1 7/2002 Voss et al.
6,474,394 B1 11/2002 Kuhar
6,491,084 B1 12/2002 Voss et al.
6,508,293 B1 1/2003 Huang (Continued)

*Primary Examiner*—David Purol
(74) *Attorney, Agent, or Firm*—Lerner, David, Littenberg, Krumholz & Mentlik, LLP

(57) ABSTRACT

A window covering, a lifting mechanism for a window covering and a locking device for a lifting mechanism are disclosed. The lifting mechanism includes main body, a pair of cord spools rotatably mounted to the main body, and a pair of coil springs that rotate a member separate from the cord spools, and the member rotates the spools to wind the cord onto the spools. The locking device includes a main body, a cord slot associated with the main body and a locking arm having a cord channel in sliding engagement with the main body and having a channel, and a biasing mechanism to move the cord channel out of alignment with the slot and releasably lock the cord in position

39 Claims, 10 Drawing Sheets

U.S. PATENT DOCUMENTS

| | | | | |
|---|---|---|---|---|
| 6,536,503 | B1 | 3/2003 | Anderson et al. | |
| 6,575,223 | B1 * | 6/2003 | Chung et al. | 242/378.4 |
| 6,644,372 | B1 * | 11/2003 | Judkins | 160/84.04 |
| 6,644,375 | B1 * | 11/2003 | Palmer | 160/84.04 |
| 6,675,861 | B1 * | 1/2004 | Palmer et al. | 160/170 |
| 6,761,203 | B1 * | 7/2004 | Huang | 160/170 |
| 6,823,925 | B1 * | 11/2004 | Militello et al. | 160/170 |
| 2002/0011315 | A1 | 1/2002 | Ciuca et al. | |
| 2002/0033241 | A1 | 3/2002 | Palmer | |
| 2002/0088562 | A1 | 7/2002 | Palmer | |
| 2002/0157796 | A1 | 10/2002 | Judkins | |
| 2003/0024656 | A1 | 2/2003 | Ciuca | |
| 2003/0070767 | A1 | 4/2003 | Workman et al. | |

* cited by examiner

WINDOW COVERING WITH LIFTING MECHANISM

FIELD OF THE INVENTION

This invention relates to window coverings and lifting mechanisms, methods of raising window coverings using such lifting mechanisms, and locking devices for such lifting mechanisms.

BACKGROUND OF THE INVENTION

Window coverings such as Venetian blinds and cellular shades are typically raised with an outer pull cord. Venetian blinds typically comprise a plurality of horizontal slats suspended beneath a headrail by two or more flexible ladder laces. The ladder laces each include a pair of vertically extending side cords interconnected by a plurality of vertically spaced slat supporting rungs, and the upper ends of the ladders are attached to a ladder drum or tilt drum to tilt the slats in response to turning of the ladder drum. Carriers for the several ladders typically are rotated in unison by a tilt rod. Cellular shades typically comprise a headrail, a bottom rail, and a continuous, collapsible web of material suspended between a headrail and a bottom rail that is raised or lowered with an outer pull cord.

Recent improvements to Venetian blind and cellular shade lifting mechanisms have involved the use of spring motor lifting mechanisms. Spring motor lifting mechanisms provide lifting force for the bottom rail and the window covering, and the lifting mechanism allows the lifting cords to be concealed in the body of the window covering. The cords are stored on spools associated with the lifting mechanism. Spring motors are well-known and generally include a flat ribbon of pre-stressed spring metal coiled to have a natural or relaxed state in which the spring forms a tightly wound coil. Although a variety of lifting mechanisms presently exist, improvements in lifting mechanisms are needed. It would be desirable to provide an inexpensive and compact window covering lifting mechanism and improved locking devices for such lifting mechanisms.

SUMMARY OF THE INVENTION

In accordance with one or more embodiments of the present invention, a window covering and a lifting mechanism for a window covering are provided. In certain embodiments, the lifting mechanism comprises a main body and a pair of cord spools rotatably mounted on the main body, each of the cord spools connected to one of a pair of cords associated with the window covering. The lifting assembly, according to these embodiments, further includes a drum rotatably mounted on a central portion of the main body, the drum in rotatable engagement with the pair of cord spools, and a pair of coil springs connected to the drum, the coil springs biased to rotate the drum in a manner to rotate the cord spools to wind the each of cords onto one of the spools. According to certain embodiments, a locking mechanism is provided to prevent the cords from winding onto the spools. In embodiments that include window coverings, the window covering includes a lifting mechanism such as the type described immediately above, a head rail, a bottom rail, a window covering between the head rail and the bottom rail and a pair of cords connecting the head rail, the bottom rail, and the window covering.

Another aspect of the invention relates to a cord take-up device or lifting mechanism for a window covering. According to one or more embodiments, the take-up device or lifting mechanism comprises a main body, a pair of cord spools rotatably mounted on the main body, each of the cord spools connected to one of a pair of cords associated with the window covering, a pair of coil springs positioned and biased to rotate a member separate from the cord spools, and the member rotates the cord spools such that the cord spools wind the cords onto the spools, and a locking mechanism to prevent the cords from winding onto the spools.

Still another aspect of the invention relates to a window covering cord release device or locking mechanism. According to one or more embodiments, the release device or locking mechanism comprises a main body having a first cord slot for guiding a cord onto a take-up spool, a first locking arm in sliding engagement with a portion of the main body and having a channel therethrough, and a biasing mechanism to move the first locking arm channel out of alignment with the first cord slot to releasably lock the cord in position.

Still another aspect of the invention relates to a method of raising or lowering a window covering such as a Venetian blind or a cellular shade. According to one or more embodiments, the method comprises providing a window covering including a head rail, a bottom rail, a window covering between the head rail and the bottom rail, a pair of cords connecting the head rail, the bottom rail, and the window covering, and a lifting mechanism associated with the bottom rail. According to these embodiments, the lifting mechanism comprises a main body and a pair of cord spools rotatably mounted on the main body, each of the cord spools connected to one of the pair of cords. The method further includes lifting the bottom rail such that the cord spools are driven by member separate from the cord spools and a biasing means to take up the cord on the spools as the bottom rail is being raised.

BRIEF DESCRIPTION OF THE DRAWINGS

A more complete appreciation of the subject matter of the present invention and the various advantages thereof can be realized by reference to the following detailed description in which reference is made to the accompanying drawings in which.

DETAILED DESCRIPTION OF EXEMPLARY EMBODIMENTS

Before describing several exemplary embodiments of the invention, it is to be understood that the invention is not limited to the details of construction or process steps set forth in the following description. The invention is capable of other embodiments and of being practiced or carried out in various ways.

In overview, one or more embodiments of the invention relates to a window covering lifting mechanism. Certain embodiments relate to window coverings utilizing lifting mechanisms. Other embodiments relate to locking devices or release devices for window lifting mechanisms. Still other embodiments involve methods of lifting window coverings.

Figure 1:
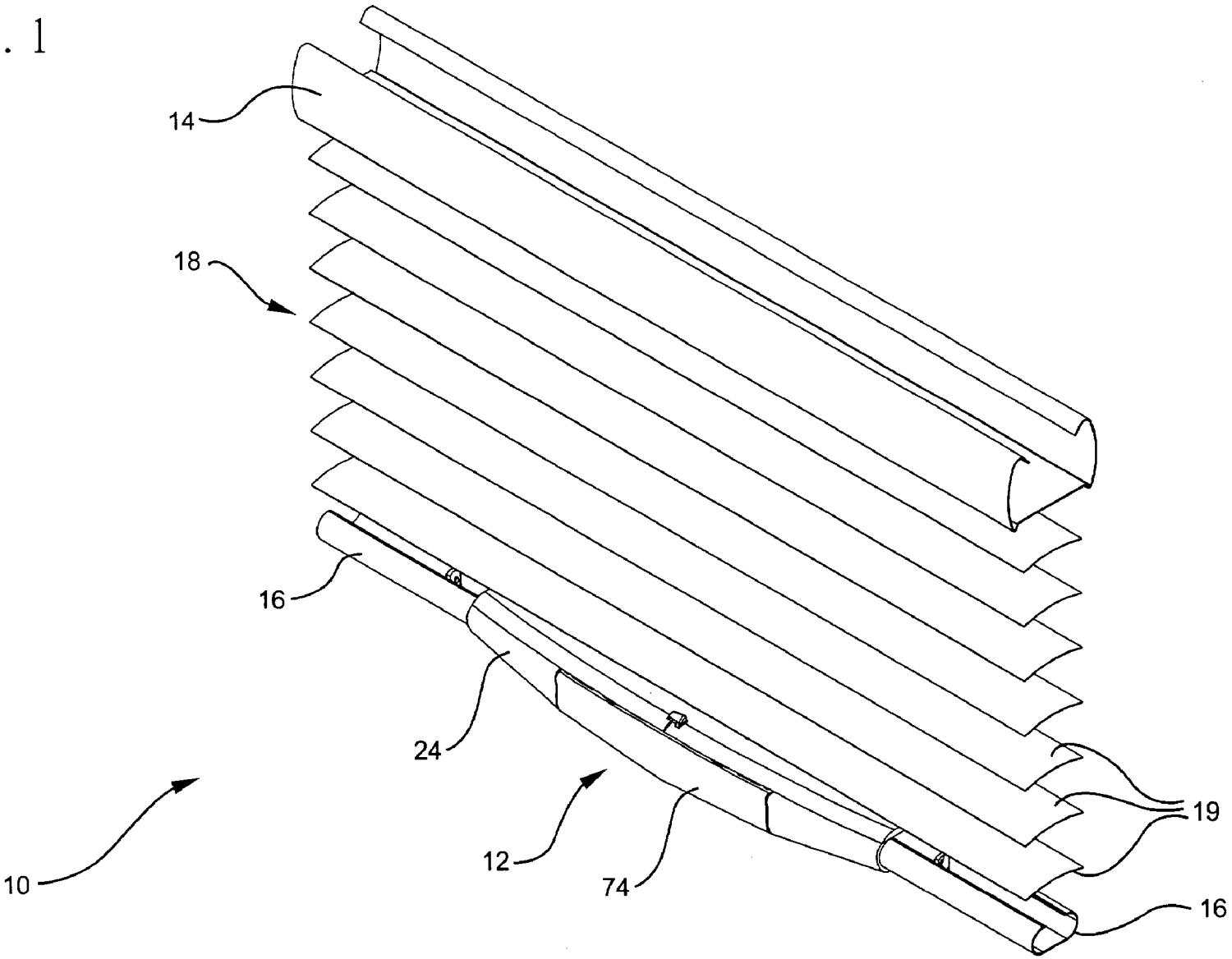
FIG. 1 is a perspective of a blind assembly according to one embodiment of the present invention.
Figure 2:
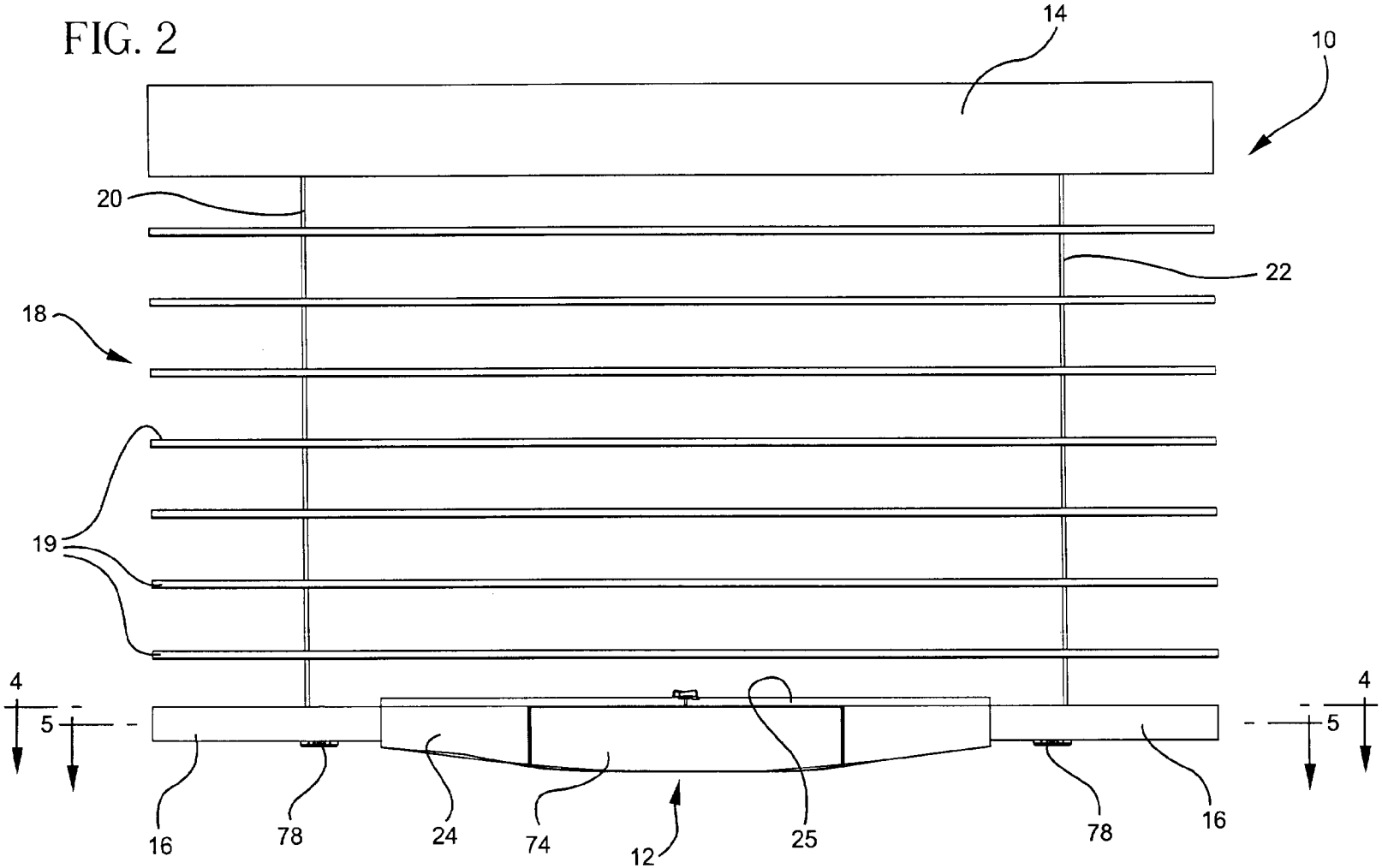
FIG. 2 is a rear view of the blind assembly shown in FIG. 1.
Figure 3:
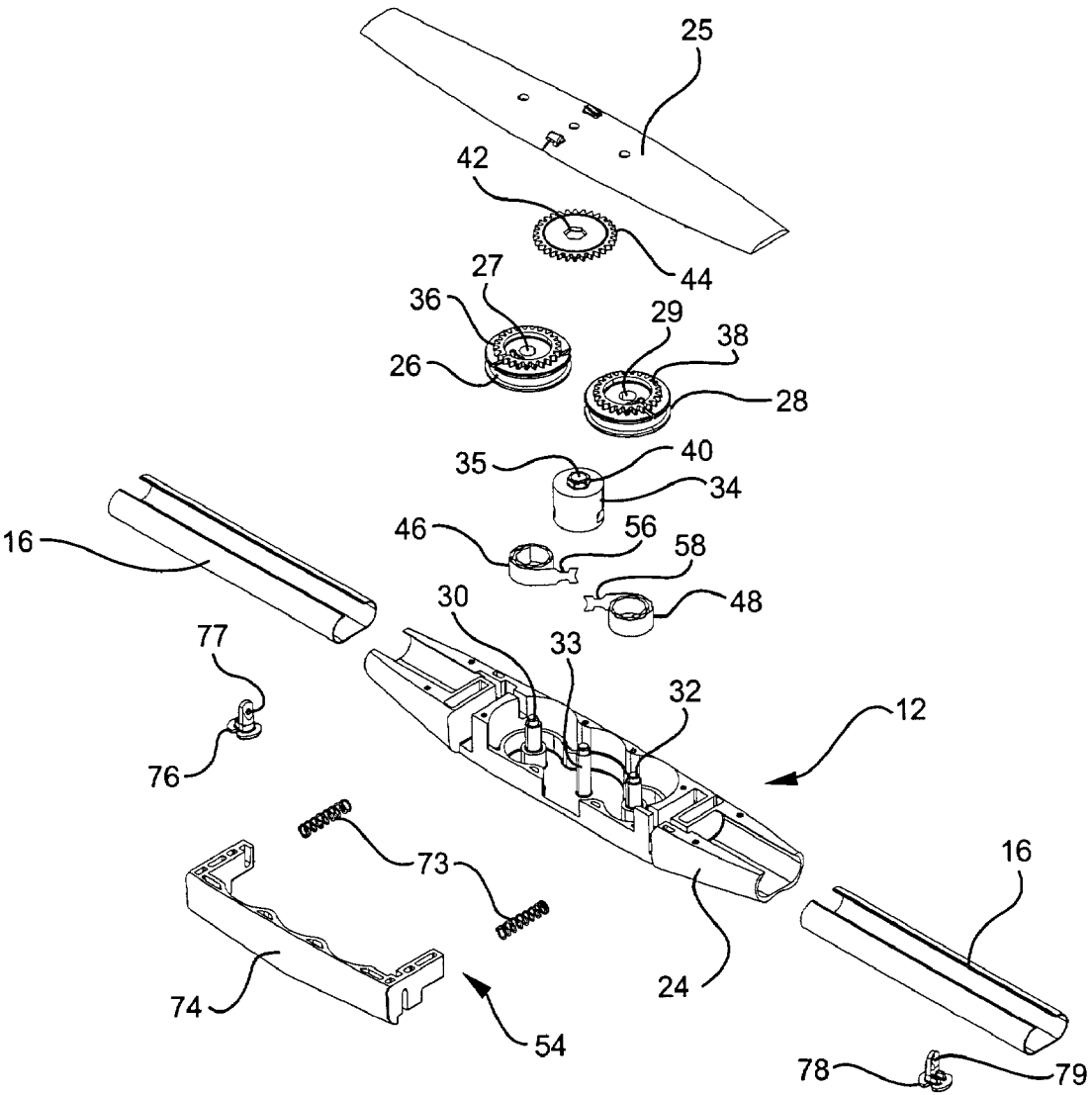
FIG. 3 is an exploded perspective view of a lifting mechanism for a blind according to one embodiment.
Figure 4:
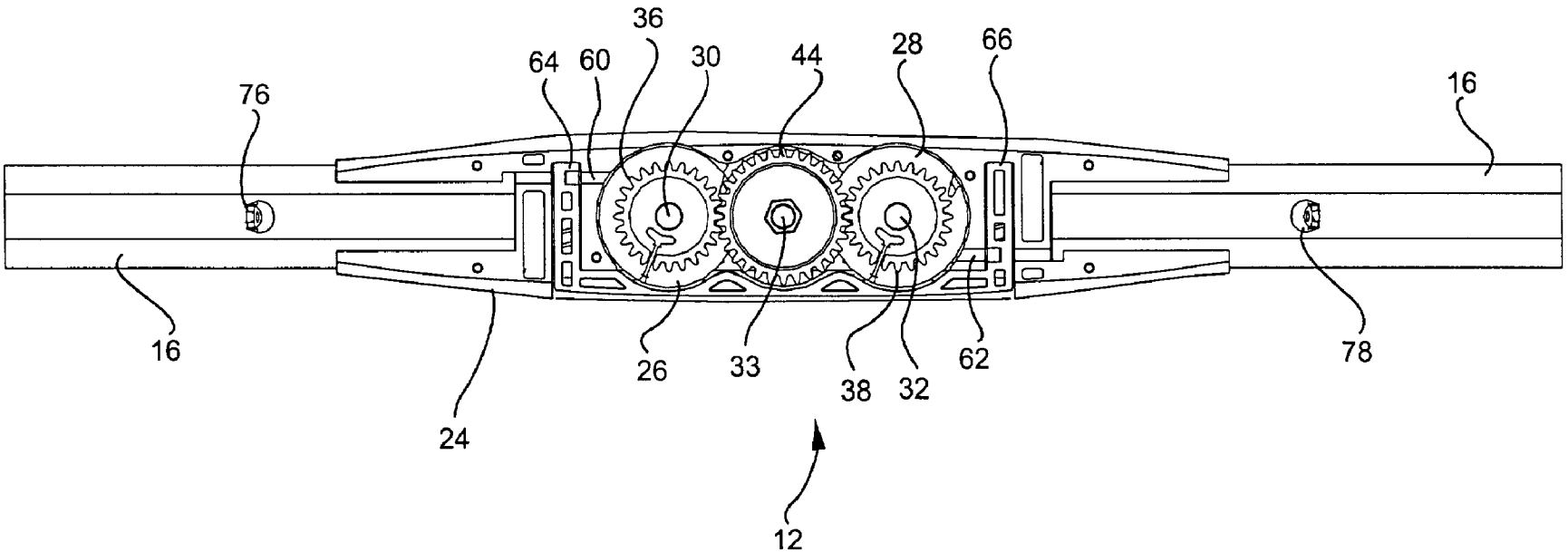
FIG. 4 is a cross-sectional view taken along line 4—4 of FIG. 2.

Referring to the drawings and generally to FIGS. 1–6, a window covering assembly 10 utilizing a lifting mechanism 12 is shown according to one or more embodiments. FIGS. 1 and 4 show a Venetian blind assembly 10. Venetian blind assemblies typically include a head rail 14, a bottom rail 16, and a window covering 18 extending between the head rail 14 and the bottom rail 16. The window covering 18 shown in FIGS. 1 and 4 includes a plurality of individual slats 19 as is known in the art of Venetian blinds. A pair of cords 20, 22 connects the head rail 14, the bottom rail 16, and the window covering 18. In the embodiment shown in FIGS. 1 and 4, the lifting mechanism 12 is associated with the bottom rail 16.

Figure 5:
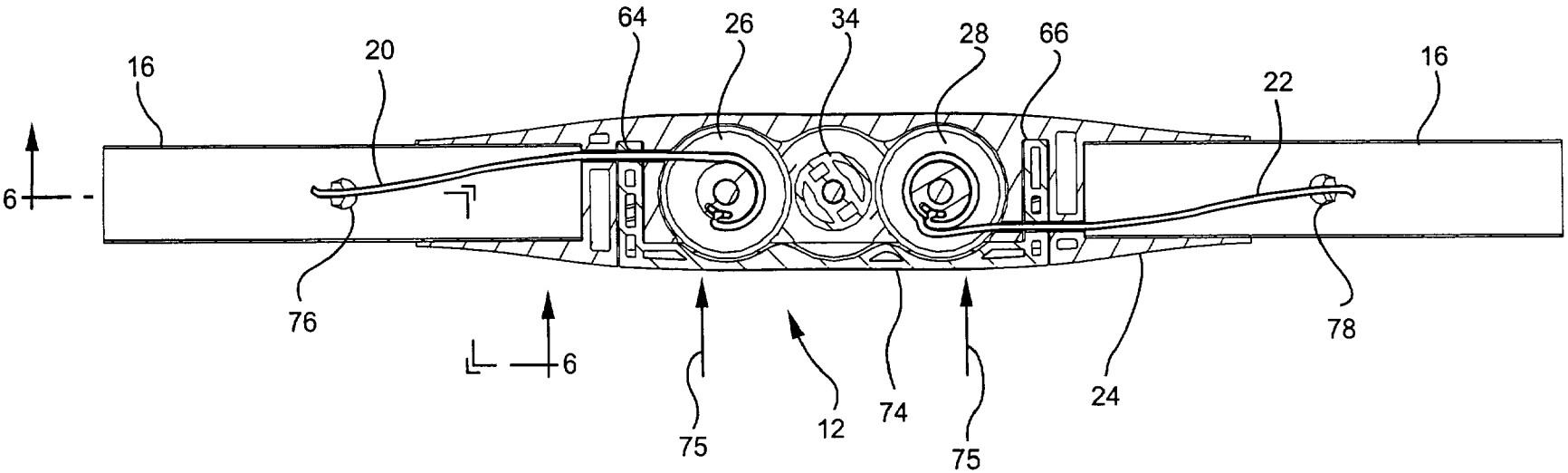
FIG. 5 is a cross-sectional view taken along line 5—5 of FIG. 2.

Referring now particularly to FIGS. 3, 4 and 5 and according to one or more embodiments, the lifting mechanism 12 comprises a main body 24 and a top plate 25, a pair of cord spools 26, 28 rotatably mounted on the main body 24 and disposed between the main body and top plate 25. The cord spools 26, 28 are generally cylindrical in shape, and each of the spools includes a bore 27, 29. The cord spools 26, 28 may be mounted on a pair of spindles or posts 30, 32, and each of the spindles or posts adapted to receive one of the spools 26, 28 through their respective bores, 27, 29 and to allow the spools to freely rotate. It will be understood that the spools can be mounted to the main body 24 by other suitable means. Each of the cord spools 26, 28 are connected to one of the pair of cords 20, 22, as will be described in more detail below.

Figure 7:
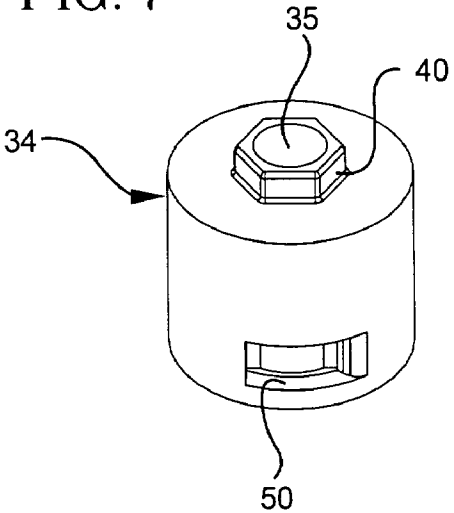
FIG. 7 is a top perspective view of a drum used in a lifting mechanism according to one embodiment.
Figure 10:
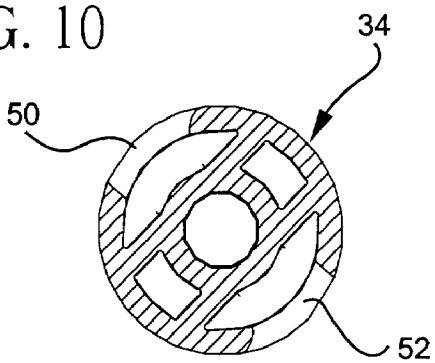
FIG. 10 is a cross-sectional view taken along line 10—10 of FIG. 9.
Figure 9:
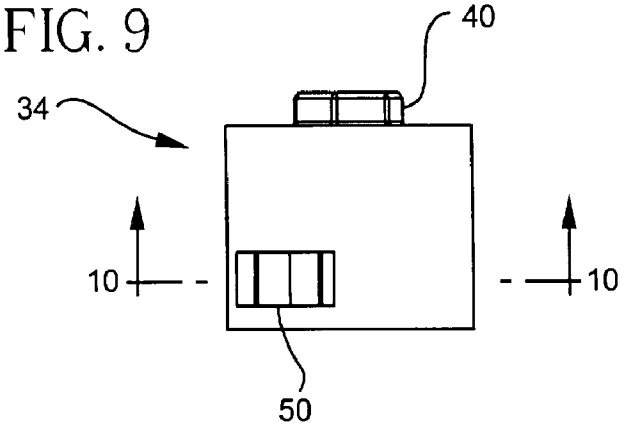
FIG. 9 is a side view of the drum shown in FIG. 7.
Figure 11:
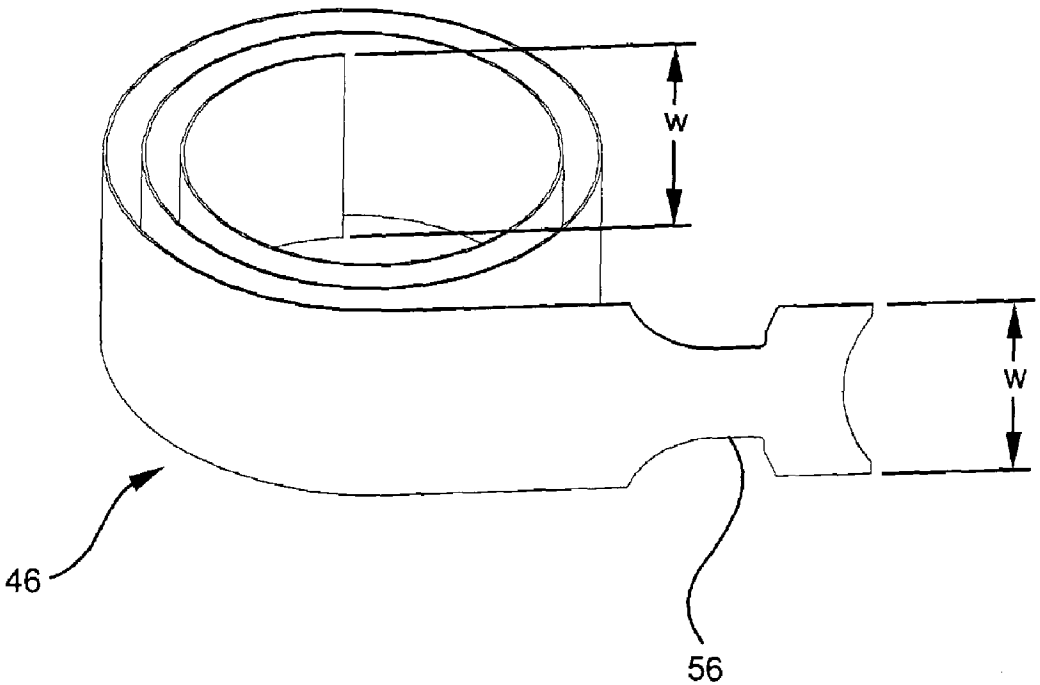
FIG. 11 is perspective view of a coil spring according to one embodiment.

The lifting mechanism 12 further comprises a drum 34 rotatably mounted on a central portion of the main body 24. The drum 34, like the spools 26, 28, may include a bore 35, as best seen in FIG. 7. The central portion of the main body 24 may further include a spindle 33 adapted to receive the bore 35 of the drum 34 to allow the drum 34 to freely rotate on the spindle 33.

According to one or more embodiments, the drum 34 is in rotatable engagement with the pair of cord spools 26, 28. The drum 34 is preferably in rotatable engagement with the cord spools 26, 28 via engagement surfaces such as gears associated with each of the spools 26, 28 and the drum 34. For example, spool 26 may include a gear 36, and spool 28 may include a gear 38, both of which engage with a gear 44 associated with the drum 34. As shown in the Figures, the spool gears 36, 38 are integral with the spools 26, 28, and the drum spool gear 44 is a separate component from the drum 34. This design facilitates assembly and disassembly of the lifting mechanism, however, it is understood that the various embodiments are not limited to this design. Thus, for example, the spool gears 36, 38 may be separate components that can be mounted on their respective spools 26, 28, and the drum gear 44 can be integral with the drum 34. Of course, other variants are possible. All of the gears may be integral with their respective spools and drum, or all of the gears may be separate components from their respective spools and drum.

Mounting of the drum gear 44 on the drum 34 may be accomplished by providing complementary mating surfaces on the drum 34 and gear 44. For example, the drum 34, may include a male hexagonal surface 40, as seen in FIG. 7, and the gear 44 may include a female hexagonal opening 42 adapted to be received on the male hexagonal surface 40. Alternatively, the gear 44 may include a male hexagonal surface while the drum may include a hexagonal recess (not shown) adapted to receive the male surface on the gear 44. Other mating surfaces for mounting the gear 44 on the drum 34 may be utilized.

According to one or more embodiments, the lifting mechanism 12 further includes a pair of coil springs 46, 48 disposed loosely around spindles 30, 32, but without storage spools. Preferably, each of the coil springs 46, 48 is located coaxially with each of the cord spools 26, 28. Thus, in the embodiments shown in the Figures, the cord spools 26, 28 are respectively disposed above the coil springs 46, 48. The coil springs 46, 48 are connected, on one end, to the drum 34. When the window covering is in a raised position, a major portion of the coil spring is wrapped around its respective spindle. When the bottom rail is pulled down and the window covering is lowered, a portion of each spring is transferred onto the drum. The two springs 46, 48 are attached to the center drum 34 and configured in a way that when center drum 34 is rotated while the blind is being lowered, both of springs 46, 48 resist (or act opposite) such rotation. When the window covering is raised again by lifting the bottom rail and releasing a locking device(described below), the coil springs 46, 48 are biased to rotate the drum 34, and the drum rotates the cord spools 26, 28 to wind the each of cords 20, 22, onto their respective spools. Thus, the coil springs 46, 48, do not directly drive the cord spools 26, 28, and they are not in contact with the cord spools. In other words, while the window covering is being raised, the coil springs 46, 48 are biased to rotate a member separate from the cord spools, and this member in turn rotates the cord spools. The coil springs are selected and biased with sufficient force so that the cord spools 26, 28 are driven with sufficient force by the drum 34 to take up their respective cords 20, 22 while the blind is being raised.

Preferably, the coil springs 46, 48 are releasably attached to the drum 34. As best shown in FIGS. 7–11, the drum 34 has spring engagement surfaces 50, 52, which, in the embodiment shown are in the form of arcuate slots formed in the drum 34. Preferably the drum is hollow, and each spring 46, 48 has a partially narrowed end section 56, 58. The springs 46, 48 preferably have the same thickness and the width "w" of the spring is substantially the same over the length of the spring. In preferred embodiments, both ends of each spring 46, 48 have the same width. The partially narrowed end sections 56, 58 provide an engagement surface with the spring engagement surfaces 50, 52 of the drum. Thus, each of the springs 46, 48 are engaged with the drum 34 by inserting the narrowed end sections 56, 58 in one of the arcuate slots in the drum 34 and then turning the end section 56, 58 approximately 90 degrees to lock the spring 46, 48 to the drum. Of course, other means can be used to engage the springs 46, 48 and the drum. For example, tabs, complementary spindles and openings and other means can be utilized to engage the spring 46, 48 and the drums.

According to one or more embodiments, the lifting mechanism 12 further includes a release device or locking mechanism 54 to releasably lock the cords in place and prevent the cords from winding onto the spools when the window covering assembly is in a lowered position on a window. Preferably the locking mechanism 54 is associated with the main body 24 of the lifting mechanism 12. Further details on the release device or locking mechanism 54 are shown in FIGS. 4–6, and 12. In preferred embodiments, the locking mechanism 54 is associated with the main body 24 of the lifting mechanism 12. The main body 24 includes a pair of cord slots 60, 62 that are wide enough to allow the cords 20, 22 to travel therethrough without binding when the cords are being released from or wound on their respective spools 26, 28. As used herein, the term slot includes open passages or grooves and closed passages or holes. The locking mechanism further comprises at least a first, and preferably a pair of locking arms 64, 66, which are attached to locking handle 74, in sliding engagement with the a portion of the main body 24.

Figure 12:
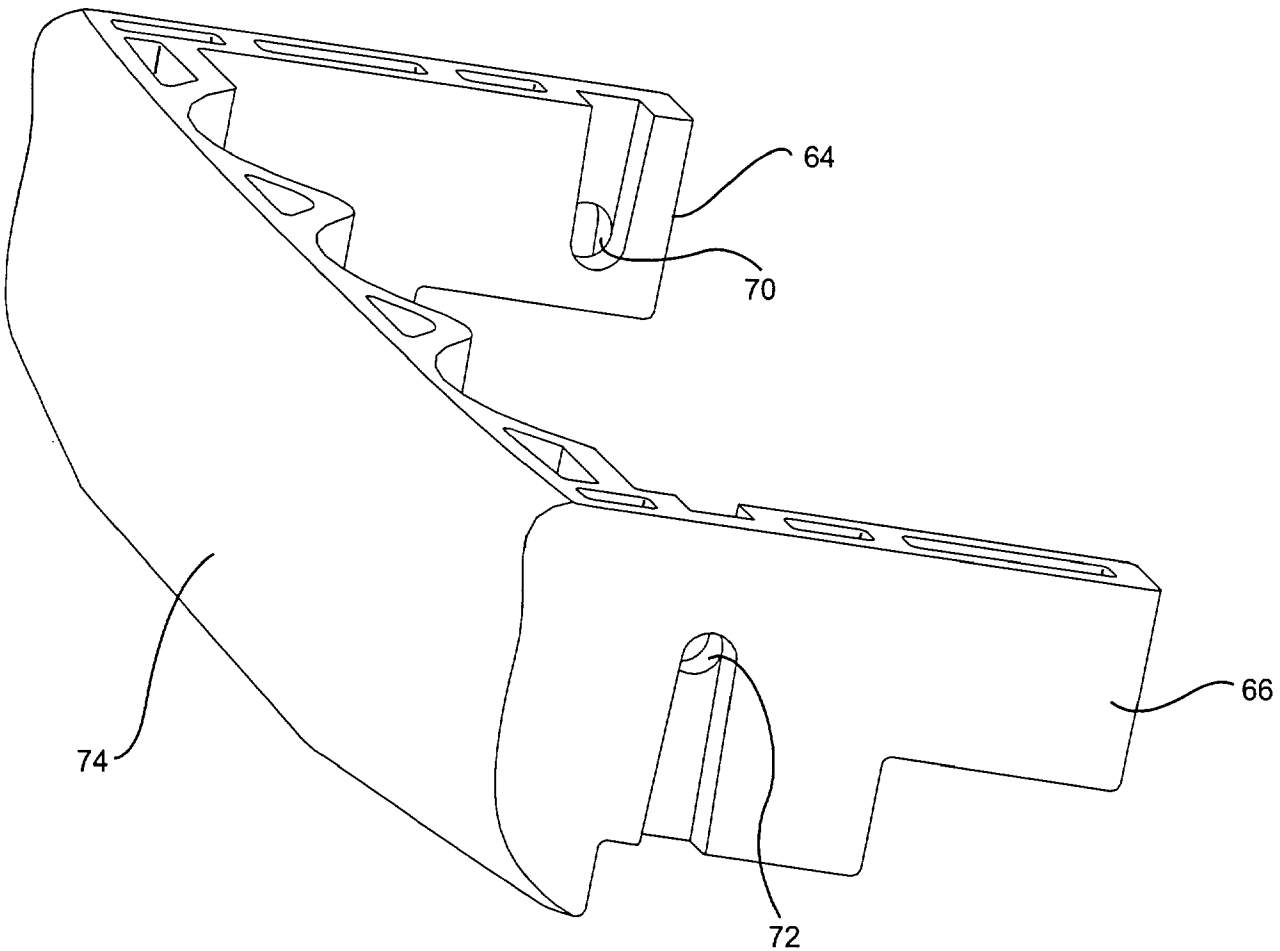
FIG. 12 is a perspective view a portion of a locking device used in a lifting mechanism according to one embodiment.

As best shown in FIG. 12, the locking arms 64, 66 each have a channel 70, 72 through the arm for allowing the cord 20, 22 to travel therethrough freely when the cord is being released from or wound on the spool. As used herein, channel is not limited to an open passage through the locking arm, and it can include a closed passage through the locking arm. As shown in FIG. 3, the locking mechanism 54 includes a biasing mechanism including at least one spring 73 for moving the locking arm channel 70, 72 out of alignment with their respective cord slot 60, 62 to releasably lock the cords 20, 22 in position. Preferably, the biasing mechanism includes a pair of springs 73. Thus, in the relaxed state the locking mechanism 54 is in the biased and locked position and the cord 20 is pinched by the out of alignment locking arm channel 70 and slot 60. Similarly, in the locked position, cord 22 is pinched by the out of alignment locking arm channel 72 and cord slot 62. As best shown in FIG. 5, when compressive force is applied to the locking arms 64, 66 through handle 74, the cord channel 70 in locking arm 64 is brought into alignment with cord slot 60 of the main body 24. Similarly, the cord channel 72 in locking arm 66 is brought into alignment with cord slot 62 in the main body 24. Conveniently, the locking arms 64, 66 are part of a locking handle 74 that can be compressed by gripping the lifting mechanism 12 in the hand and squeezing the locking handle 74 in the direction shown by arrows 75 in FIG. 5. It will be appreciated that the size of the slots and channels will depend on the size of the cord used to fabricate the window covering, and a skilled artisan can select the proper size slot and channel.

In use, the cords 20, 22, are taken up on the spools 26, 28 when the cords are released from the pinched configuration by squeezing the locking handle 74 and lifting up on the bottom rail 16. The coil springs 46, 48 rotate the drum 34 and cause the cord spools 26, 28 to take up the cords as the bottom rail is being lifted. In one or more embodiments, the drum provides substantially uniform rotation for each of the pair of spools 26, 28, resulting in even lift of the window covering. Thus, when the hand-operated locking mechanism 54 is released and it is desired to move the bottom rail 16 upward, the tendency of the springs 46, 48 to return to their natural state causes the center drum 24 to rotate in a direction that causes the springs 46, 48 to return to positions loosely surrounding the posts 30, 32. This causes the center gear 44 to rotate, which in turn causes the two cord gears 36, 38 to rotate, thus taking in lift cord. The frictional resistance of the locking mechanism can be overcome by pulling downward to lower the blinds so that the release does not have to be pressed to lower the blind.

Figure 6:
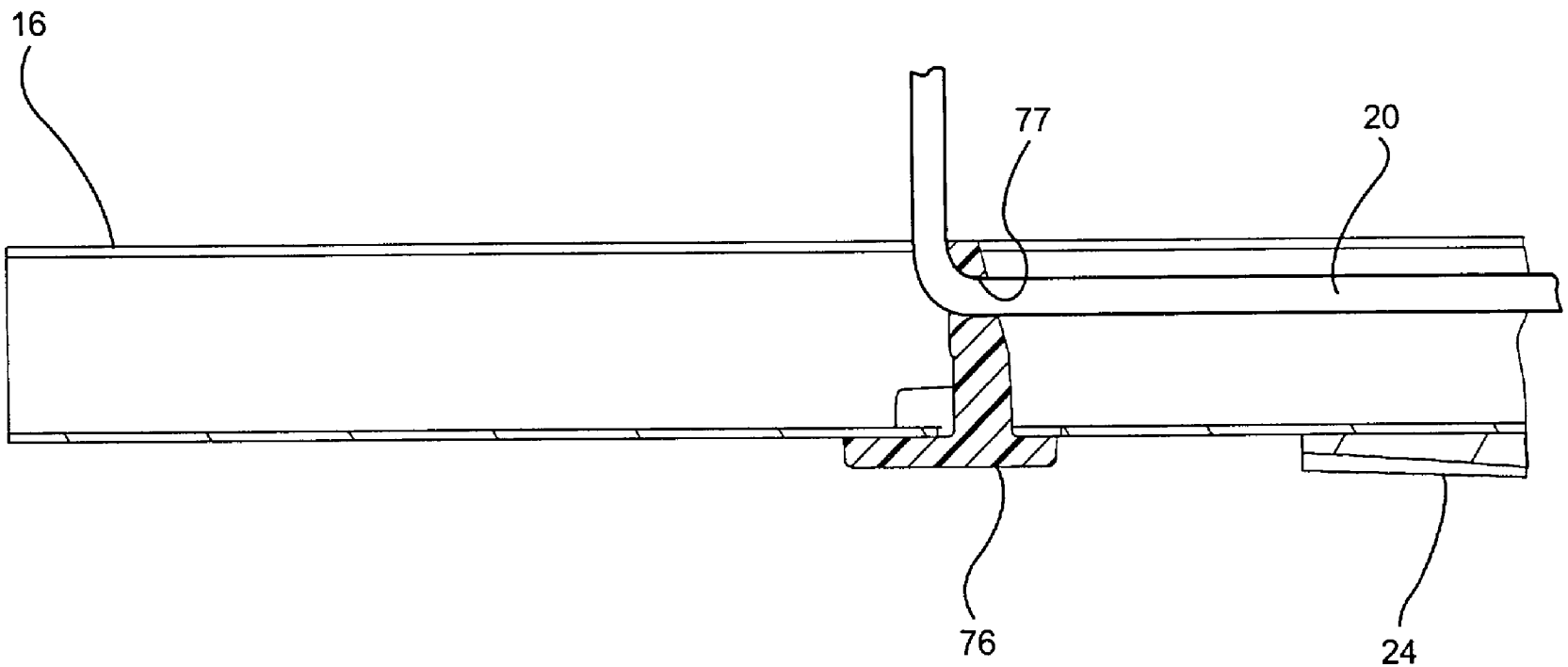
FIG. 6 is a partial cross-sectional view of the lifting mechanism taken along line 6—6 of FIG. 5.
Figure 8:
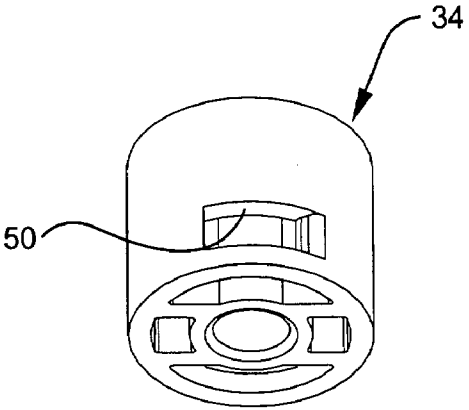
FIG. 8 is a bottom perspective view of the drum shown in FIG. 7.

Referring to FIGS. 3 and 6, another aspect of the invention provides a pair of plugs 76, 78 having respective openings 77, 79 therethrough adapted to guide the cords 20, 22 from a horizontal orientation in the bottom rail 16 to a substantially vertical orientation to guide the cords 20, 22 up through the window covering and the headrail. The plugs 76, 78 are preferably press fit in the bottom rail 16, however, they may also be screw fit or adhesively attached to the bottom rail 16. When the lifting mechanism 12 is employed in a horizontal blind which includes a tilt ladder, the plugs 76, 78 are also used to anchor the outer rails of the tilt ladder in a fixed position within the bottom rail.

Thus, according to one or more embodiments of the present invention, a lifting mechanism is provided in which two springs are taken up by a central drum, which acts as a single output drum, providing a compact, powerful unit that provides even lift of the window covering. The two separate springs are positioned directly below the cord spools but not directly connected to the cord spools, which maximizes the use of space of the bottom rail. Thus, the lifting mechanism can replace a portion of the bottom rail and be an integral part of the rail. The locking mechanism can be concealed from view by positioning the locking mechanism to face the rear of the bottom rail. The lifting mechanism is compact in design, in part due to the fact that the locking mechanism includes two relatively thin arms 64, 66 that are inserted into main body of the lifting mechanism, with cord channels or openings being located in those arms.

Figure 13:
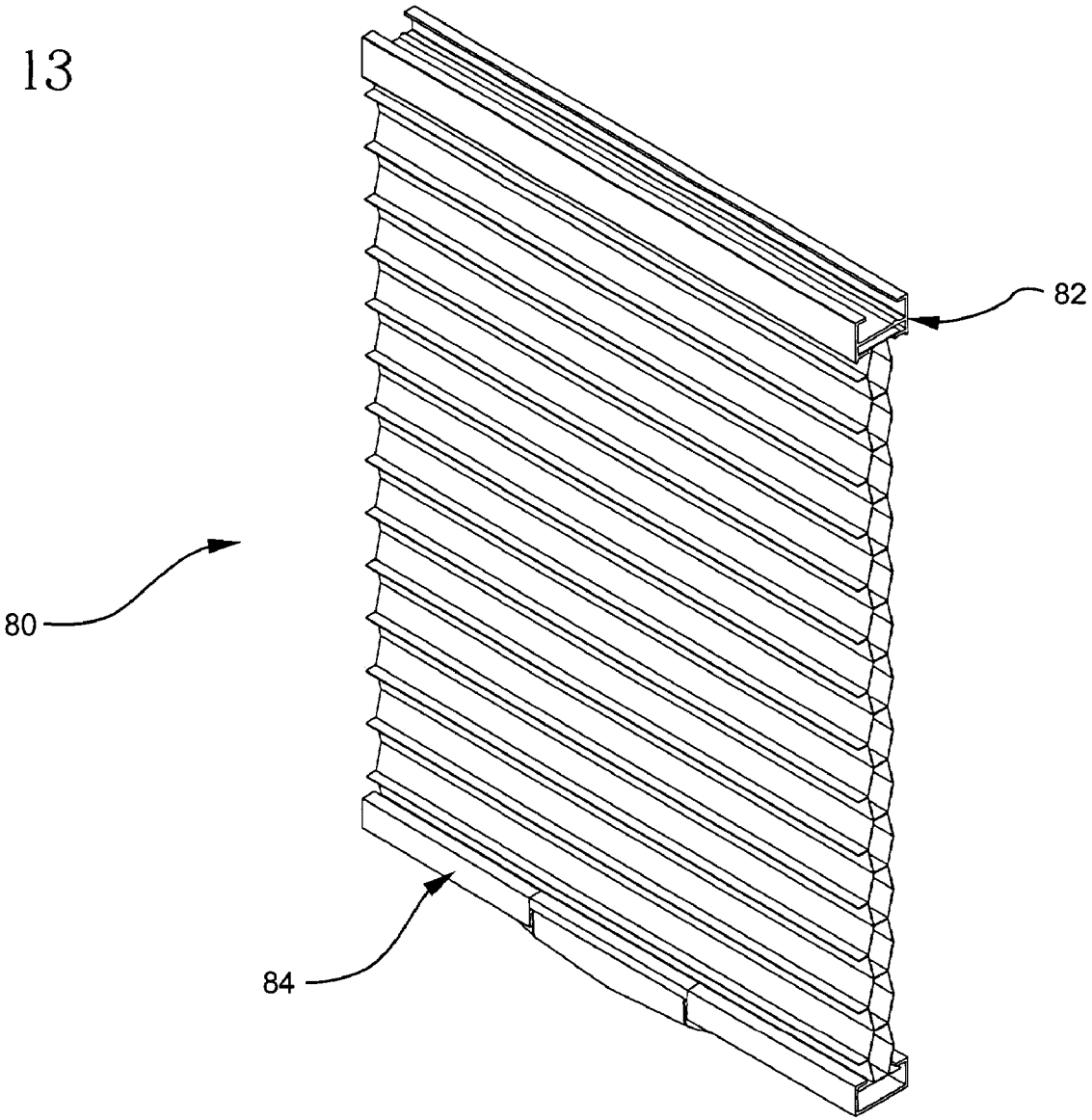
FIG. 13 is a perspective view of a cellular shade assembly including a lifting mechanism according to one embodiment.

Although the lifting mechanism has been described with respect to a Venetian blind, it will be appreciated that the lifting mechanism can be used with other types of window coverings. For example, as shown in FIG. 13, the lifting mechanism can be used with a cellular shade 80 including a headrail 82 and a bottom rail 84. The lifting mechanism may be modified to fit the type of bottom rail required for cellular shades.

Although the invention herein has been described with reference to particular embodiments, it is to be understood that these embodiments are merely illustrative of the principles and applications of the present invention. For example, although the various embodiments show a pair of cords, more cords could be used in the fabrication wider window covering assemblies. It is therefore to be understood that numerous modifications may be made to the illustrative embodiments and that other arrangements may be devised without departing from the spirit and scope of the present invention as defined by the appended claims.

The invention claimed is:

1. A window covering assembly comprising:

a head rail;

a bottom rail;

a window covering between the head rail and the bottom rail;

a pair of cords connecting the head rail, the bottom rail, and the window covering;

a lifting mechanism associated with the bottom rail comprising:

a main body; a pair of cord spools rotatably mounted on the main body, each of the cord spools connected to one of the pair of cords; a drum rotatably mounted on a central portion of the main body, the drum in rotatable engagement with the pair of cord spools; and a pair of coil springs connected to the drum, the coil springs each being biased to rotate the drum which rotates the cord spools to wind the each of cords onto one of the spools; and a locking mechanism to releasably secure the cords in position.

2. The window covering of claim 1, wherein the drum and each of cord spools include a gear portion, the gear portions of each spool engaging with the gear portion of the drum.

3. The window covering of claim 2, wherein one of each of the coil springs is located approximately coaxially with the one of the spools.

4. The window covering of claim 3, wherein each of the spools is located above a coil spring.

5. The window covering of claim 4, wherein the locking mechanism is associated with the bottom rail.

6. The window covering of claim 5, wherein the locking mechanism is associated with the main body of the lifting mechanism.

7. The window covering of claim 5, wherein the locking mechanism includes a first cord slot in the main body for guiding a cord onto one of the cord spools; a first locking arm in sliding engagement with a portion of the main body and having a channel therethrough for receiving a cord; and a biasing mechanism to move the first locking arm channel out of alignment with the first cord slot to releasably lock the cord in position.

8. The window covering of claim 7, wherein the biasing mechanism includes a spring.

9. The window covering of claim 8, wherein the locking mechanism includes a second cord slot associated with the other of the cords spools, a second locking arm in sliding engagement with a portion of the main body and having a channel therethrough for receiving a cord.

10. The window covering of claim 9, wherein the locking mechanism is adapted to be released by applying force against the spring bias and aligning each of the cord slots with their respective locking arm channels such that the cord freely moves through the channel and slot and permitting the coil springs to cause the cord spools to wind the cords.

11. The window covering of claim 1, further comprising a pair of plugs located in the bottom rail and having openings therethrough adapted to guide the cords from a horizontal orientation in the bottom rail to a substantially vertical orientation.

12. A cord take-up device for a window covering comprising:

a main body;

a pair of cord spools rotatably mounted on the main body, each of the cord spools connected to one of a pair of cords associated with the window covering;

a pair of coil springs positioned within said main body and biased to rotate a drum separate from the cord spools and the drum rotates the cord spools such that the cord spools wind the cords onto the spools; and a locking mechanism to prevent the cords from winding onto the spools.

13. The device of claim 12, wherein the drum is rotatably mounted on a central portion of the main body, the drum in rotatable engagement with each of the pair of cord spools.

14. The device of claim 13, wherein the drum provides uniform rotation of each of the pair of spools.

15. The device of claim 14, wherein the drum and each of the cord spools include a gear portion, the gear portions of each spool in contact with the gear portion of the drum.

16. The device of claim 15, wherein one of each of the coil springs is located approximately coaxially with the one of the spools.

17. The device of claim 16, wherein each of the spools is located above a coil spring.

18. The device of claim 17, wherein the locking mechanism is associated with a bottom rail of a window covering.

19. The device of claim 18, wherein the locking mechanism is associated with the main body of the lifting mechanism.

20. The device of claim 19, wherein the locking mechanism includes a first cord slot in the main body for guiding a cord onto one of the cord spools; a first locking arm in sliding engagement with a portion of the main body and having a channel therethrough for receiving a cord; and a biasing mechanism to move the first locking arm channel out of alignment with the first cord slot to releasably lock the cord in position.

21. The device of claim 20, wherein the biasing mechanism includes a spring.

22. The device of claim 21, wherein the locking mechanism includes a second cord slot associated with the other of the cords spools, a second locking arm in sliding engagement with a portion of the main body and having a channel therethrough for receiving a cord.

23. The device of claim 22, wherein the locking mechanism is adapted to be released by applying force against the spring bias and aligning each of the cord slots with their respective locking arm channels such that the cord freely moves through the channel and slot and permitting the coil springs to cause the cord spools to wind the cords.

24. A cord take-up device for a window covering comprising:

a main body;

a pair of cord spools rotatably mounted on the main body, each of the cord spools connected to one of the pair of cords;

means within said main body for rotating a drum separated from the cords spools that in turn rotates the cord spools such that the cord spools wind the cords onto the spools; and releasable locking means to prevent the cords from winding onto the spools.

25. A spring motor driven window covering comprising:

at least one cord; and a cord release device including:

a main body having a first cord slot for guiding the cord onto a take-up spool;

a first locking arm in sliding engagement with a portion of the main body and having a channel therethrough ; and a biasing mechanism to move the first locking arm channel out of alignment with the first cord slot to releasably lock the cord in position.

26. The device of claim 25, wherein the biasing mechanism includes a spring.

27. The device of claim 26, wherein the cord release device includes a second cord slot associated with the other of the cords spools, a second locking arm in sliding engagement with a portion of the main body and having a channel therethrough for receiving a cord.

28. The device of claim 27, wherein the cord release device is adapted to be released by applying force against the spring bias and aligning each of the cord slots with their respective locking arm channels such that the cord freely moves through the channel and slot and permitting the coil springs to cause the cord spools to wind the cords.

29. The window covering of claim 28, further including a cellular shade.

30. The window covering of claim 28, further including blind slats.

31. A method of raising a window covering including either a cellular shade or a venetian blind comprising:

providing a window covering including a head rail, a bottom rail, a window covering between the head rail and the bottom rail, a pair of cords connecting the head rail, the bottom rail, and the window covering, and a lifting mechanism associated with the bottom rail the lifting mechanism comprising a main body and a pair of cord spools rotatably mounted on the main body, each of the cord spools connected to one of the pair of cords; and lifting the bottom rail such that the cord spools are driven by a drum separate from the cord spools in contact with biasing means such that the cord spools take up cord as the bottom rail is being raised.

32. The method of claim 31, wherein the biasing means includes a pair of coil springs biased to rotate the drum.

33. The method of claim 32, further comprising providing a locking mechanism in the bottom rail.

34. The method of claim 33, further comprising threading the cord through the bottom rail and the locking mechanism.

35. The method of claim 34, further comprising providing means for changing direction of the cords as the cords exit the bottom rail.

36. The method of claim 35, wherein the means for changing direction of the cords comprises a pair of cord plugs having bores therethrough.

37. A take up mechanism for a window covering comprising:

a main body;

a pair of cord spools rotatably mounted on the main body, each of the cord spools connected to one of a pair of cords associated with the window covering;

a pair of coil springs positioned within said main body and biased to rotate a drum which rotates the cord spools such that the cord spools wind the cords onto the spools;

a removable gear mounted on the drum in contact with a portion of each cord spool.

38. The take up mechanism of claim 37, wherein each cord spool includes a gear in contact with the gear mounted on the drum.

39. The take up mechanism of claim 38, wherein the cord spool gears are integrally formed with the cord spools.

* * * * *